United States Patent [19]

Haigh

[11] 4,131,955

[45] Jan. 2, 1979

[54] GARMENT EMBLEM

[75] Inventor: Thomas I. Haigh, Holland, Pa.

[73] Assignee: The Franklin Institute, Philadelphia, Pa.

[21] Appl. No.: 757,568

[22] Filed: Jan. 7, 1977

[51] Int. Cl.[2] ..... A41D 27/08

[52] U.S. Cl. ..... 2/246; 40/594; 428/284; 428/287; 428/339

[58] Field of Search ..... 428/153, 233, 236, 246, 428/248, 573, 512, 537, 102, 332, 337, 339, 281, 287, 286, 511; 2/246, 244; 40/594, 586, 615, 2 R

[56]. References Cited

U.S. PATENT DOCUMENTS

| | | | |
|---|---|---|---|
| 1,962,682 | 6/1934 | Case | 428/233 |
| 2,335,222 | 11/1943 | Storch | 2/246 |
| 3,574,667 | 4/1971 | Fournier | 428/246 |
| 3,684,643 | 8/1972 | Stepp | 428/513 |
| 3,958,056 | 5/1976 | Brugh, Jr. et al. | 428/511 |

*Primary Examiner*—Stanley S. Silverman
*Attorney, Agent, or Firm*—Jackson and Chovanes

[57] ABSTRACT

This involves a laminate having preferably a 15 mil layer of cloth such as especially a 65-35% blend of polyester and cotton, a 2.5 mil layer of non-creped paper tissue, and in between them an 8 mil layer of low density polyethylene which has penetrated into the paper just short of appearing on its face, and a corresponding amount into the cloth. It will preferably be bonded together by ten seconds bonding time at 435° F under ten psi platen pressure. The laminate is especially useful as an inexpensive non-curling product for use as emblems, especially where it is intended to be put into a Merrow sewing machine for special stitching and then sewn onto the garment on which it is intended to be displayed.

6 Claims, 1 Drawing Figure

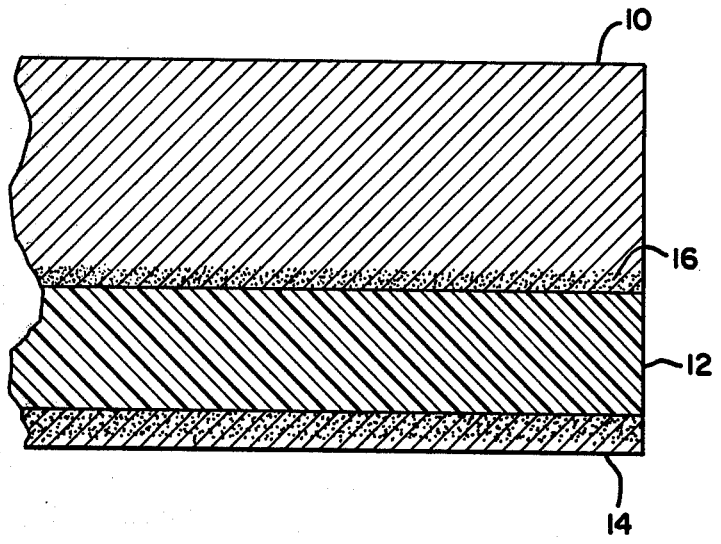
10
16
12
14

GARMENT EMBLEM

SUMMARY OF THE INVENTION

The present invention relates to a laminate.

It is a purpose of the invention to provide such a laminate which is notable for not curling but maintaining a flat condition even in circumstances where other materials often have a great tendency to curl.

It is a further purpose to do this with a material that is decidedly inexpensive, especially as compared to other materials that might be thought of as possibilities for similar uses.

It is a further purpose to provide a material which is especially suitable and valuable for use as emblems, and has a highly desirable appearance and "feel" for such use.

It is a further purpose to provide a material for emblems which can readily be removed from one garment without substantial impairment of either garment or emblem, and sewn on another garment with the aid of the ordinary facilities available for such a purpose in the home.

BRIEF DESCRIPTION OF THE DRAWING

The FIG. which constitutes the drawing shows a sectional view, broken away, taken across the laminar portions at one end of the preferred embodiment of my invention.

MORE SPECIFIC DESCRIPTION

Describing this in illustration, and not in limitation, in the preferred embodiment there is outermost layer 10, shown at the top, of cloth such as especially a 65%—35% blend of polyester and cotton respectively, an intermediate layer 12 of low density polyethylene, and an inner layer 14 of uncreped paper. In the portion 16 of the cloth layer nearest the polyethylene layer, the polyethylene has penetrated into the cloth. The polyethylene also has penetrated into the paper tissue, preferably to a place just short of where it would appear on the outer face of that paper layer.

This penetration will be secured preferably by having the laminate at 435° F under 10 psi bonding pressure for 10 seconds. A variation of 5° F in either direction in the temperature, 1 psi in either direction in the pressure and one-half second in either direction in the time, is not to be expected to substantially affect the result as far as substantial achievement of the optimum is concerned. If desired, different and especially lower temperatures such as 400° F for example could be used, but other factors such as especially the time under pressure would then have to be adjusted, - for example to 40 seconds. There is a practical limit to adjustment of the temperature upward which is imposed by the danger of burning the material, so that 500° F for example should be avoided.

The cloth layer 10 will preferably be 15 mils (thousandths of an inch) thick, but may as a practical matter be as little as 12 mils or as much as 25 mils.

The cloth layer, which as indicated will most preferably be a blend of 65% polyester and 35% cotton, may also for example be a 50–50 blend of the two or 80% polyester and 20% cotton, to mention two other commercial blends of the two which would be suitable, and instead can also be entirely of some natural fiber such as cotton.

The paper tissue layer will preferably be 2.5 mils thick, but may be as little as 1 mil or as much as 4 mils. As indicated, it will preferably be uncreped paper tissue, but if desired, paper tissue with what is known in the trade as "minimum crepe" can be used.

The intermediate layer of low density polyethylene will preferably be 8 mils thick, but may be as little as 6 mils or as great as 10 mils, considering merely what there is as a layer of such polyethylene, while including what is merely impregnated with it as a part of the other layers whose thickness has already been discussed previously. As indicated this penetration in the case of the paper will preferably be just short of appearing on the outside surface, and in the case of the cloth an approximately corresponding amount as the case may be. Where the paper tissue layer is the preferred 2.5 mils in thickness, this penetration in the case of the cloth might be around 2 mils.

Preferably the low density polyethylene should be such a material having a specific gravity of about 0.916, but any such material having a specific gravity of 0.940 or below would be considered a low density polyethylene and might be used. Also, while low density polyethylene is preferable, other low density polyolefins could also be used, including especially low density polypropylene.

The laminate of the present invention is useful especially for making emblems to be worn on garments.

In the making of these emblems, it is usual to employ a Merrow sewing machine, to provide a rather complex stitch which gives a good appearance to the emblem. For such an operation, a flat material is required, whereas many materials which might otherwise be tried in such a connection have a pronounced tendency to curl, especially if their manufacture has called for the employment of a relatively high temperature, after which they cool.

The material of the present invention holds its flatness extrememly well and does not curl even in cooling down from a reasonably high temperature such as is employed in this connection.

Furthermore, the material of the present invention is relatively inexpensive, as compared to the sort of thing which the trade feels impelled to go to, in order to get the other qualities that it wants in a material for emblems.

Also, the material of the present invention has the other qualities desired of such a material, and has them to an outstanding degree. For example, its appearance and "hand" or "feel" are especially good for this purpose.

What is more, the material of the present invention is especially long lasting, standing up without impairment under about fifty commercial launderings, with no indication in the test which went to this point that their limit of wearability in this respect was at all being approached. This is in contrast for example to starched buckram which is often used for this purpose, which does not last nearly as well and starts to lose its starch with the very first washing, despite the relative overall expense of the material in question.

Also, the material of the present invention lends itself to relatively inexpensive automatic operations which can be done at high rates of speed by the personnel involved, whereas the starching of the buckram above mentioned is an enormously slower, more tedious operation requiring much more time and expense of labor employed, the time required to turn out a certain amount of the finished material being as much as ten or more times as great in the case of the starching operation as in the automatic laminating operation involved in the present invention.

Another special value of the present material in its proposed use is that the emblem does not tend to stick to the garment on which it is used, unlike the type of emblem which is intended to be pressed into place upon the garment. Thus an emblem of the present material lends itself to being sewed upon the garment, and when its usefulness on that particular garment is ended, can be removed without impairing either the emblem or the garment, which is not true where the two have been pressed together in reliance on this causing adhesion between them. Thereafter it will be possible to sew the emblem upon another garment as may be desired, employing nothing more in this than will be found in the ordinary home — no unusual automatic machinery likely to be found only in some industrial establishment. Thus the present material lends itself especially well to such things as boy scout or girl scout emblems, which can be sewed by the mother of the family onto the garment of the oldest brother or sister and later removed by her and sewed on what the younger brother or sister is wearing when the older member of the family grows up and the younger brother or sister joins the same organization.

In view of my invention and disclosure, variations and modifications to meet individual whim or particular need will doubtless become evident to others skilled in the art to obtain all or part of the benefits of my invention without copying the material shown, and I, therefore, claim all such insofar as they fall within the reasonable spirit and scope of my claims.

Having thus described my invention what I claim as new and desire to secure by Letters Patent is:

1. An emblem for garments comprising a laminate adapted especially for use as a removable emblem and which avoids curling during manufacturing of the emblem, consisting of an intermediate and two outsie layers, all laminated together as a three-part laminate, one of the outside layers being a layer about fifteen mils thick of cloth of about 65 percent polyester and 35 percent cotton, the other of the outside layers being a layer about two and a half mils thick of uncreped paper tissue and the intermediate layer being one about eight mils thick of low density polyethylene which has a specific gravity of about 0.916, the polyethylene also penetrating the paper tissue to a place just short of appearing on the surface and penetrating the cloth approximately correspondingly in distance, as a result of being held at 435° F ± 5° under a platen pressure of 10 ± 1 psi for a time of 10 ± ½ seconds.

2. An emblem for garments comprising a laminate comprising an intermediate and two other layers, which other layers are directly laminated to respective opposite sides of the intermediate layer, the intermediate layer being a layer of 0.94 specific gravity or less polyethylene which is about eight mils thick, one of the other layers being a layer of cloth of a polyester and cotton blend which is about fifteen mils thick, and the other of the other layers being a layer of uncreped or minimum crepe paper tissue which is about two and a half mils thick, the polyethylene impregnating the paper tissue layer to a place just short of its face away from the intermediate layer and impregnating the cloth layer approximately correspondingly in distance.

3. An emblem for garments comprising a laminate comprising an intermediate and two other layer, which other layers are directly laminated to respective opposite sides of the intermediate layer, the intermediate layer being a layer of polyethylene of 0.94 specific gravity or less which is in the range from six through ten mils thick, one of the other layers being a layer of cloth of a polyester and cotton blend which is in the range from 12 through 25 mils thick, and the other of the other layers being a layer of uncreped or minimum crepe paper tissue which is in the range from one through four mils thick, some polyethylene being impregnated into the adjacent portions of the respective other layers but not to the extent of appearing on the far face of either of them.

4. An emblem for garments comprising a laminate comprising an intermediate and two other layers, each of which other layers is laminated directly to a different side of the intermediate layer, the intermediate layer being a layer of from 6 through 10 mils thickness of a polyethylene having a specific gravity of 0.94 or less, one of the other layers being of cloth which is of polyester-cotton blend or of cotton, the cloth being of from twelve through twenty five mils thickness, and the other of the layers being of uncreped or minimum crepe paper tissue of a thickness of from 1 through 4 mils, and some low density polyethylene being impregnated into the cloth but not thru to the outside face of the cloth.

5. An emblem for garments comprising a laminate comprising an intermediate layer and two other layers each of which is respectively laminated directly to a different side of the intermediate layer, the intermediate layer being a substantial layer of polyolefin and the other layers being respectively cloth and paper, and some polyolefin being impregnated into the cloth but not through to the outside face of the cloth, the thicknesses of the above-enumerated layers being respectively from 12 thru 25 mils in the case of the cloth layer, from 6 thru 10 mils in the case of the intermediate layer, and from 1 thru 4 mils in the case of the paper, the cloth layer being a polyester-cotton blend, the intermediate layer being of polyethylene having a specific gravity of 0.94 or less, and the paper layer being of an uncreped or minimum crepe tissue.

6. An emblem for garments comprising a laminated material especially adapted to become an emblem for use on garments, and in this connection one which avoids curling during the manufacturing procedure for the emblems, which consists of three layers, two outside and one intermediate, all forming a unitary laminate, the outer layers being respectively of fabric and paper and the intermediate layer being a substantial layer of a polyolefin, the intermediate being thicker than the paper, and some polyolefin being impregnated into the fabric but not through to the outside face of the fabric, the thickness of the above-enumerated layers being respectively from 12 thru 25 mils in the case of the cloth layer, from 6 thru 10 mils in the case of the intermediate layer, and from 1 thru 4 mils in the case of the paper, the cloth layer being a polyester-cotton blend the intermediate layer being polyethylene having a specific gravity of 0.94 or less, and the paper layer being of an uncreped or minimum crepe paper tissue.

* * * * *